US007048560B2

(12) United States Patent
Datan, Jr. et al.

(10) Patent No.: US 7,048,560 B2
(45) Date of Patent: May 23, 2006

(54) SYSTEM AND METHOD FOR EJECTING A HIGH EXTRACTION FORCE ELECTROMECHANICAL CONNECTOR

(75) Inventors: Catalino Datan, Jr., Santa Clara, CA (US); Mitchell Grant Poplack, Mountain View, CA (US)

(73) Assignee: Quickturn Design Systems, Inc., San Jose, CA (US)

( * ) Notice: Subject to any disclaimer, the term of this patent is extended or adjusted under 35 U.S.C. 154(b) by 0 days.

(21) Appl. No.: 11/062,047

(22) Filed: Feb. 18, 2005

(65) Prior Publication Data

US 2005/0266709 A1 Dec. 1, 2005

Related U.S. Application Data

(60) Provisional application No. 60/576,611, filed on Jun. 1, 2004, provisional application No. 60/576,691, filed on Jun. 1, 2004.

(51) Int. Cl.
*H01R 13/62* (2006.01)

(52) U.S. Cl. ..... 439/160

(58) Field of Classification Search ..... 439/159, 439/160

See application file for complete search history.

(56) References Cited

U.S. PATENT DOCUMENTS

| | | | | | |
|---|---|---|---|---|---|
| 4,780,792 | A * | 10/1988 | Harris et al. | ..... | 361/737 |
| 5,730,610 | A * | 3/1998 | Hsia et al. | ..... | 439/160 |
| 5,997,325 | A * | 12/1999 | Hara | ..... | 439/159 |
| 6,116,929 | A * | 9/2000 | Muramatsu | ..... | 439/159 |
| 6,267,614 | B1 * | 7/2001 | Good et al. | ..... | 439/327 |
| 6,582,241 | B1 * | 6/2003 | Lutz, Jr. | ..... | 439/157 |
| 6,669,497 | B1 * | 12/2003 | Westphall et al. | ..... | 439/325 |
| 6,831,832 | B1 * | 12/2004 | Haager et al. | ..... | 361/685 |

* cited by examiner

*Primary Examiner*—Gary Paumen
(74) *Attorney, Agent, or Firm*—Orrick Herrington & Sutcliffe LLP

(57) ABSTRACT

A mechanism is described for effecting the ejection of a high extraction force electromechanical connector from its mate by utilizing an ejector mechanism and without requiring custom design or manufacturing of the mating connector. One embodiment achieves this by way of rigid sliding frame which applies force to a portion of the mating connector which is otherwise intended to provide alignment guidance between the two connectors.

22 Claims, 11 Drawing Sheets

SYSTEM AND METHOD FOR EJECTING A HIGH EXTRACTION FORCE ELECTROMECHANICAL CONNECTOR

CROSS-REFERENCE TO RELATED APPLICATIONS

This application claims priority to U.S. Provisional Application Ser. No. 60/576,611 and U.S. Provisional Application Ser. No. 60/576,691, each being filed on Jun. 1, 2004. Priority to these prior applications is expressly claimed, and the disclosures of respective applications are hereby incorporated by reference in their entireties.

FIELD

The present invention relates generally to electronic connectors and more particularly, but not exclusively, to an ejection mechanism for disengagement of a high-extraction-force electromechanical connector.

BACKGROUND

Cables are used to transfer signals between various electronic systems that must communicate with each other. While integration of functions into common chassis has eliminated the need for many cables, cables themselves will continue to be used to connect disparate electronic systems. There are many reasons for this, including the fact that it is often desirable to only temporarily interconnect electronic systems. Because the cables may only temporarily interconnect electronic systems, these cables need connectors on them that can mate with corresponding connectors (sometimes referred to herein as "sockets") on the electronic systems being electronically interconnected by the cables. The connectors must mate in such a way so as to provide excellent signal integrity and a connection that is not easily disconnected inadvertently and/or accidentally. At the same time, the connectors must be easily disconnected. These goals are rendered difficult when the electronic systems being interconnected have large numbers of signals that must pass back and forth between the systems. Even with multiplexing, such cables can have a large number of wires, each of which are terminated with a pin within the connector on the cable. These pins make contact with corresponding pins in the connector on the electronic system that mates with the connector on the cable.

Prior cable interconnection interface solutions, for example in systems having high numbers of signals, use jackscrews to mechanically secure a connection between a cable and the electronic system being electrically connected to the cable. Jackscrews provide a high degree of retention force. Retention force is important because it makes it difficult for accidental disconnections. In addition, higher retention forces tend to improve the integrity of the electrical connections, which improves signal quality. These jackscrew receptacles were integrated into the connector on the electronic system.

With these prior solutions, the number of signals passing from an electronic system to the cable was not that high. Thus, when it became time to insert or remove the cable from the electronic system, the amount of insertion and extraction force required was manageable. Thus, to remove a connector, a user could simply unscrew the jackscrews, grab hold of the connector, and pull it out of its corresponding connector. Likewise, to insert the connector, the user could simply force the connector on the cable into the corresponding connector on the board, and then use the jackscrews to secure the connection.

A problem arises when the number of pins in the connectors increases, as the amount of insertion and extraction force needed for insertion and removal is substantially proportional to the number of pins in the connector. While jackscrews provide for secure connections, they provide no assistance in removing a cable. In fact, use of jackscrews increase the amount of time needed to remove the cable from the electronic system.

Likewise, as electronic systems have increased in complexity, the number of signals a cable must carry has increased dramatically. This has led to an increase in the number of pins located in the connectors. The increased number of pins in turn has led to a significant increase in the force required to insert and remove a cable from the socket on the electronic system. At the same time, the pins have become smaller and more fragile. Thus, cable insertion and removal has become much more difficult. One manner in which these contrary needs have been met is through the use of dedicated tools that are separate and apart from the connector used to properly fasten or disengage the interface.

In view of the foregoing, a need exists for an improved mechanism for ejecting electromechanical connectors that overcomes the aforementioned obstacles and deficiencies of currently-available ejection mechanisms.

SUMMARY

A connector ejection system for effecting the ejection of a connector is shown and described. Although shown and described with reference to electromechanical connectors, the connector ejection system can be configured for use with a wide range of connector types.

The connector ejection system can be configured to eject the electromechanical connector from its mating connector in any suitable manner, such as through a compact ejector mechanism, preferably without requiring custom design or manufacturing of the connector ejection system's mating connector. One embodiment achieves this by way of rigid sliding frame that applies force to a portion of the mating connector, where this portion of the mating connector is otherwise intended to provide alignment guidance between the two connectors.

One potential use for the connector ejection system described herein is for use in a "target interface" connection between a logic emulation system and a customer-designed "target system" for in-circuit emulation. Emulation systems (sometimes referred to as "emulators" and "simulation accelerators") like those sold by Cadence Design Systems, Inc., are used to verify that a user's electronic design functions as intended prior to manufacture. When using such an emulation system, the user's design is programmed into the emulator such that the emulator operates in a manner that is functionally identical to user's design. Once the emulator has been programmed to function like the user's design, a cable from the emulator can be connected to the "target system." The "target system" is the intended operating environment for the user's design. For example, a user's design can be a microprocessor and the target system could be a motherboard for a personal computer.

The connector on the cable that mates with a corresponding connector in the target system will have the same number of pins as would the package for user's electronic design. Such electronic designs can have hundreds of electrical contacts.

Connectors typically used to mate the cable from the emulator with the connector on the target system are selected for reasons of signal density, signal integrity, and mechanical robustness. In addition, such connectors preferably provide a substantially high extraction force. A high extraction force is desirable because such a high force maintains a reliable connection when the interface is connected to the target system. The embodiments described herein provide a method for extracting the connector on the interface cable from the target system when it is desired to reconfigure the hardware. As will be seen, this connection imposes minimal requirements on the designers of the target system.

It should be noted that the ejection mechanism described herein has application beyond emulation systems and could be used in any system in which an integrated cable ejection mechanism is desired for high extraction force electromechanical connectors.

Other aspects and features will become apparent from consideration of the following description taken in conjunction with the accompanying drawings.

Figure 1A:
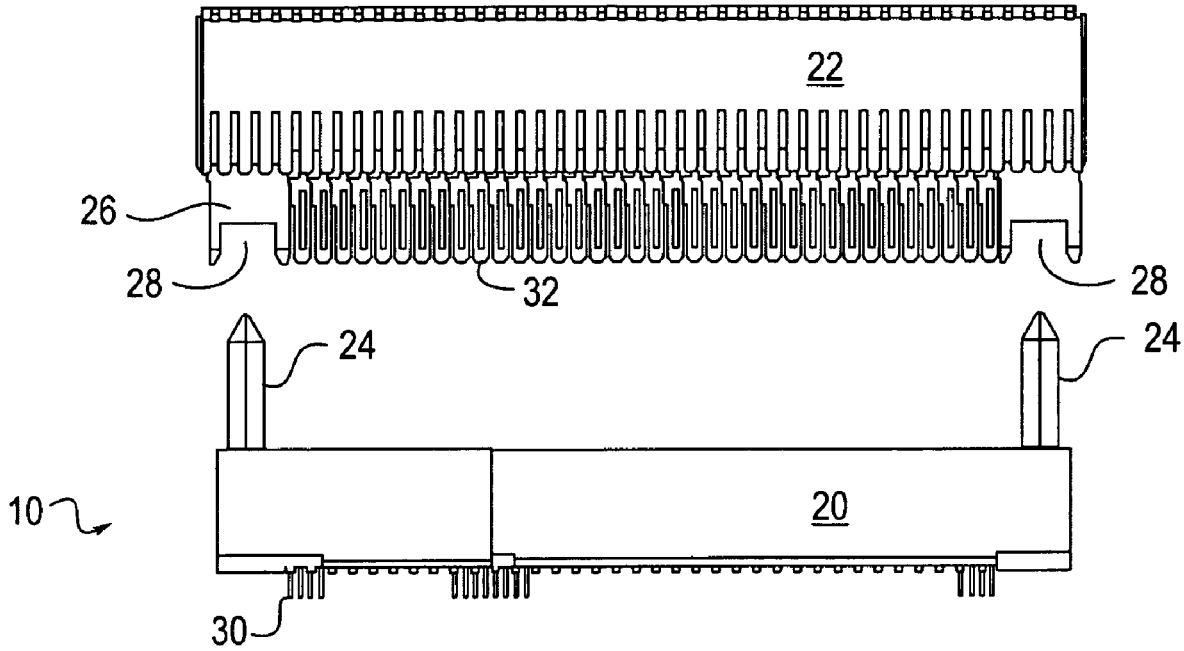
FIG. 1A (Prior Art)
FIGS. 1A–1B illustrate a prior art mating connector system.

It should be noted that the figures are not drawn to scale and that elements of similar structures or functions are generally represented by like reference numerals for illustrative purposes throughout the figures. It also should be noted that the figures are only intended to facilitate the description of the preferred embodiments of the present invention. The figures do not describe every aspect of the present invention and do not limit the scope of the invention.

DETAILED DESCRIPTION OF THE DRAWINGS

Figure 1B:
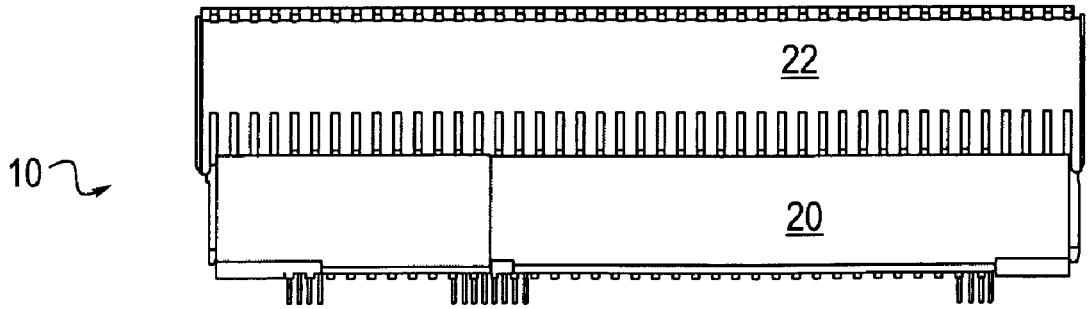
FIG. 1B (Prior Art)

An exemplary prior art mating connector system 10 shown in FIGS. 1A–1B comprises a header connector 20. The mating connector system 10 also comprises a receptacle connector 22. The header connector 20 comprises contacts 30 that can make electrical connection with traces in printed circuit boards when installed therein. Note that the word contact herein is used synonymously with the word "pin" and can be either a female contact, male contact, or any other form of electrical connection know to those having ordinary skill in the art.

The header connector 20 and receptacle connector 22 shown in FIGS. 1A–1B comprise any suitable type of mating connectors with any appropriate number and/or arrangement of contacts. As desired, the number and order of signal, power, and/or guidance modules can be specified and ordered from a connector manufacturer. The receptacle connector 22 shown in FIGS. 1A–1B has two hundred ten (210) signal contacts 32 (only one contact is labeled) and integrated ground shielding planes (not shown) disposed between substantially each column of pins. Preferably, the connectors are provided as backplane daughtercard-style modular connectors, which is what is shown in FIGS. 1A–1B. In typical mating connector systems, header connector 20 and receptacle connector 22 comprise one or more guidance modules that facilitate proper alignment between the mating connectors. The guidance modules comprise guide pins 24 and guide blocks 26 (shown in FIG. 1A). Guide blocks 26 comprise mating guide pin receptacles 28 (also shown in FIG. 1A).

Attention is now drawn to FIGS. 2–11, where a presently preferred mating connector ejection system 100 is shown. As seen in FIGS. 2A–2B, the mating connector ejection system 100 can be fitted onto an existing off-the-shelf receptacle connector 22. Preferably, guide blocks 26 found in the prior art shown in FIGS. 1A–1B are omitted in the various embodiments of the present invention. The preferred mating connector ejection system 100 comprises a pod system 12 disposed adjacent an end region of a cable 14. In one embodiment, cable 14 communicates with an electronic system (not shown) such as an emulator so that signals from that electronic system can be carried to another electronic system, such as a target system 16. In the embodiment shown in FIGS. 2A–2B, target system 16 comprises a printed circuit board 18 having a header connector 20 installed therein. The individual wires (not shown) in cable 14 communicate with corresponding contacts in receptacle connector 22, which is integrated into pod system 12.

Figure 2A:
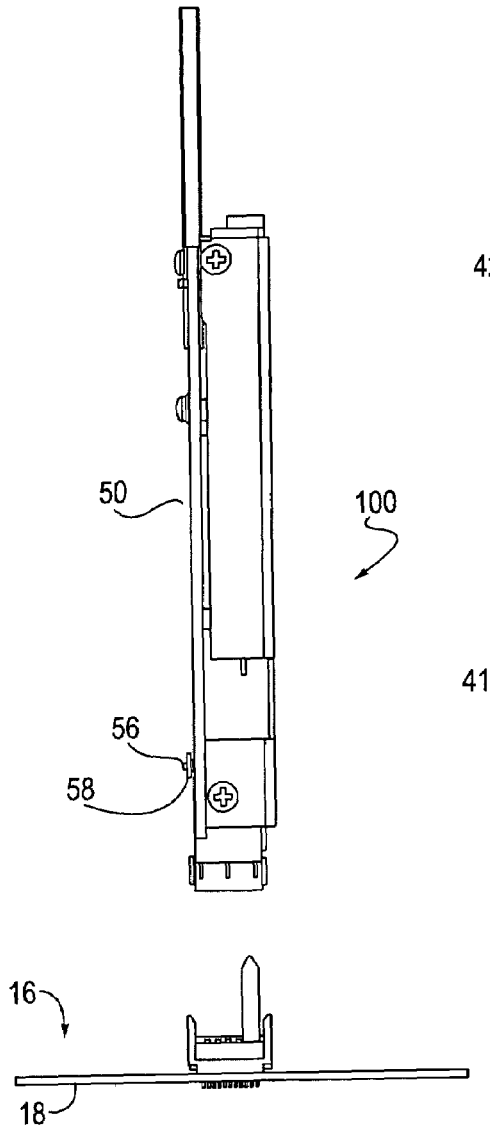
FIGS. 2A–2B illustrate an exemplary mating connector ejection system that is compatible with the connector mating system of FIG. 1.
Figure 2B:
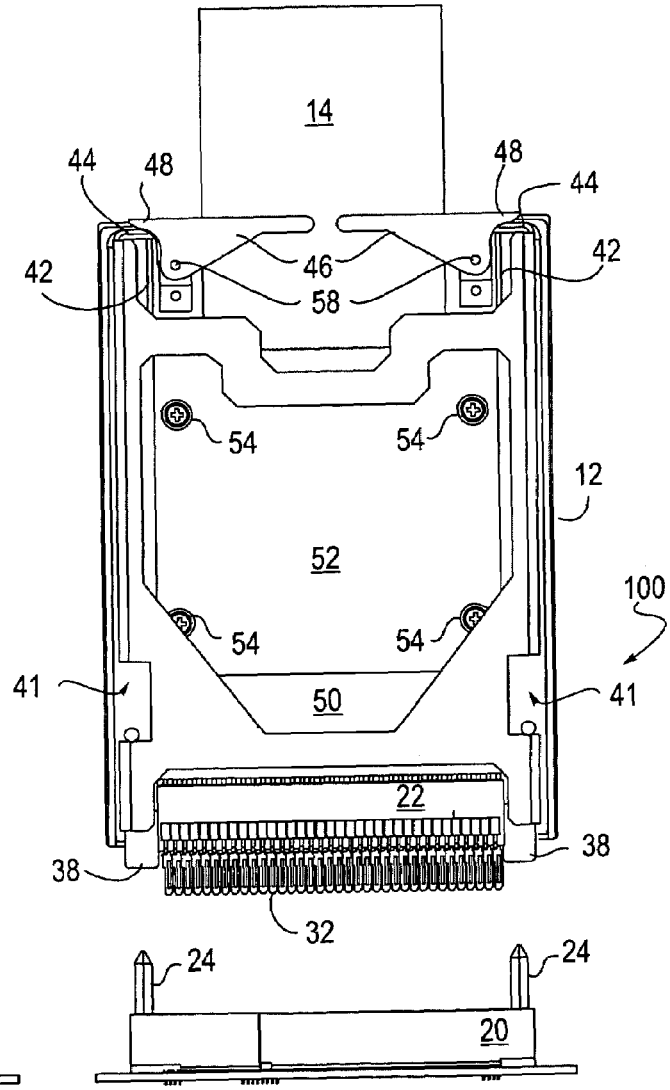
Figure 3:
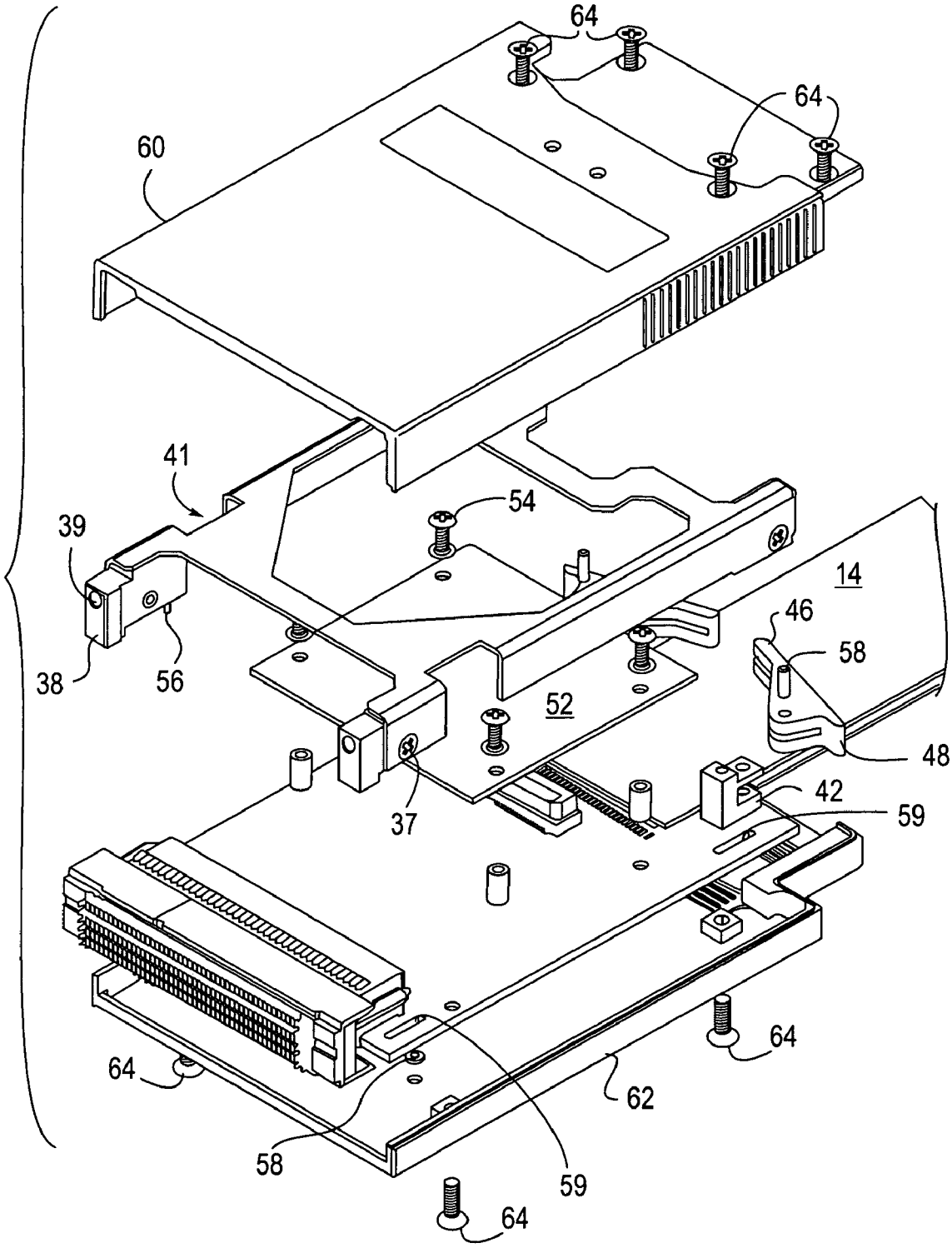
FIG. 3 illustrate an exploded view of the exemplary mating connector ejection system.

As shown in FIGS. 2A–2B & 3, cable 14 is placed in electrical communication with a backplane 50, preferably a printed circuit board 50 that has traces thereon (not shown) for transferring electrical signals between cable 14 and receptacle connector 22. Printed circuit board 50 preferably can include a mezzanine board 52 secured thereon by mounting screws 54. In one embodiment, mezzanine board 52 can comprise a power board (not shown) that regulates voltages applied to printed circuit board 50. Guidance modules 36 and custom guidance blocks 38 are affixed to frame 40. As will be described in more detail below, frame 40 is slidably connected to printed circuit board 50 by pins 56 protruding out of guidance modules 36 and also out of custom guidance blocks 38. Pins 56 further extend through slotted apertures 59 provided in printed circuit board 50. In one embodiment, frame 40 comprises pocket cutouts 41 as shown in FIGS. 2A–2B & 3. The first end of guidance modules 36 mechanically contacts ejection member 44. Ejection member 44 is preferably L-shaped such that one end of guidance module 36 can contact the tabbed portion of ejection member 44. Ejection member 44 can also extend the length of guidance modules 36 and be affixed to frame 40. Alternatively, frame 40 can be modified so as to comprise integrated ejection members 44. Such integrated ejection members 44 are also preferably L-shaped and mechanically contact with ejection levers 46.

As shown in FIGS. 2A–2B, and in more detail in FIG. 3, custom guidance blocks 38 are preferably affixed opposite the end of frame 40 where ejection member 44 is affixed. Custom guidance blocks 36 can be provided in any suitable manner and preferably are machined and affixed to frame 40. In one embodiment, custom guidance block 38 is affixed to frame 40 with a screw 37, as shown in FIG. 3. As shown in FIGS. 2A–2B & 3, one end of custom guidance block 38 preferably extend beyond frame 40 so as to be exposed at one end of frame 40. The other end of custom guidance blocks 38, as shown in FIGS. 2A–2B & 3, preferably extend upwards but terminates at a length so as to be substantially covered by frame 40 and not be exposed at pocket cutouts 41 of frame 40. As will be described below, custom guidance blocks 38 mechanically contact guide pins 24 while the mating connector ejection system 100 is in an engaged state.

If desired, the target side of the connection (i.e., header connector 20) can comprise a commercially available component. (Note that guide blocks 26 of receptacle connector 22 found in the prior art shown in FIGS. 1A–1B can be omitted. Instead, guide blocks 26 can be replaced with one or more custom guidance blocks 38).

Figure 4:
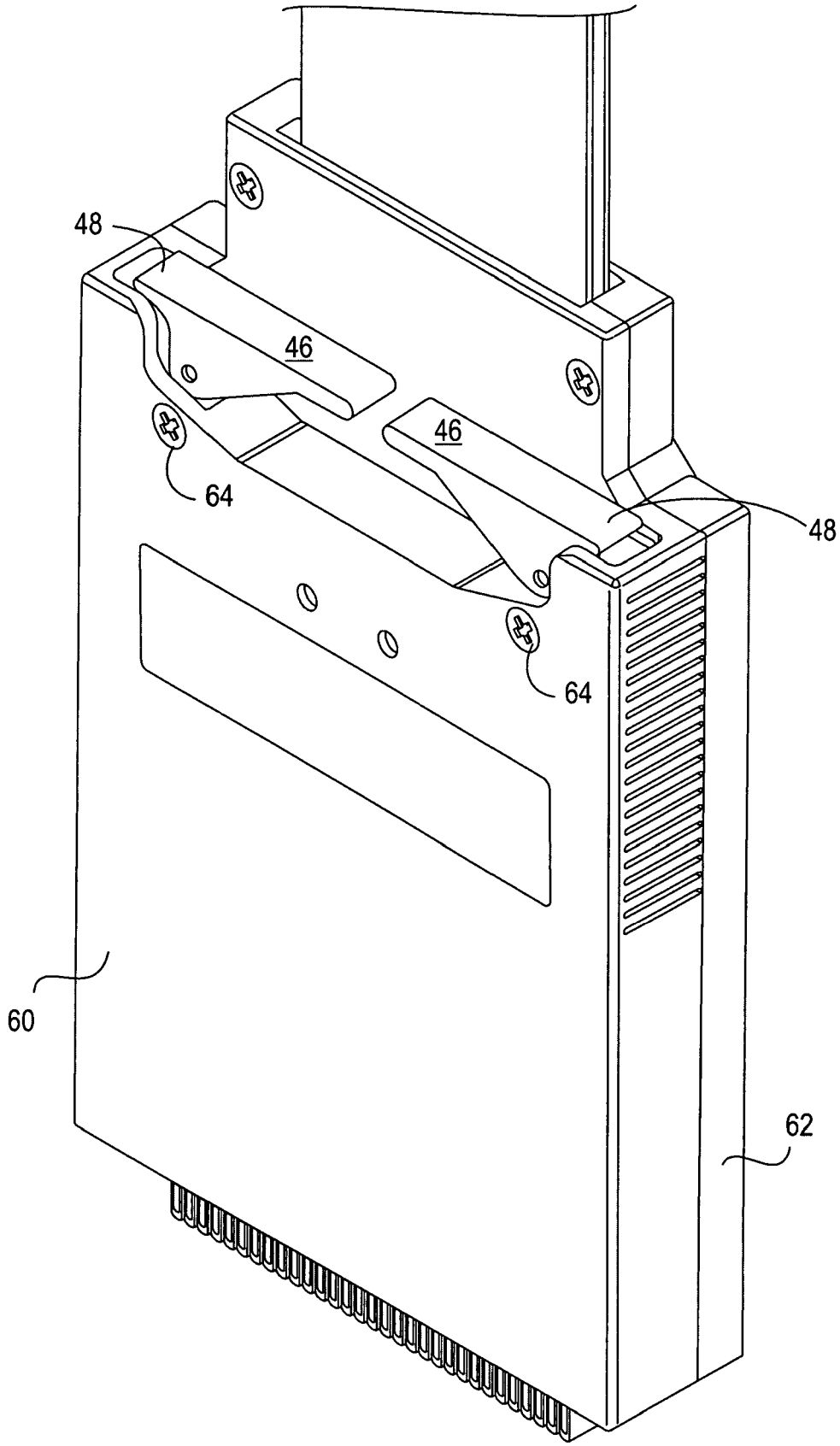
FIG. 4 is a perspective drawing of the exemplary mating connector ejection system.
Figure 5:
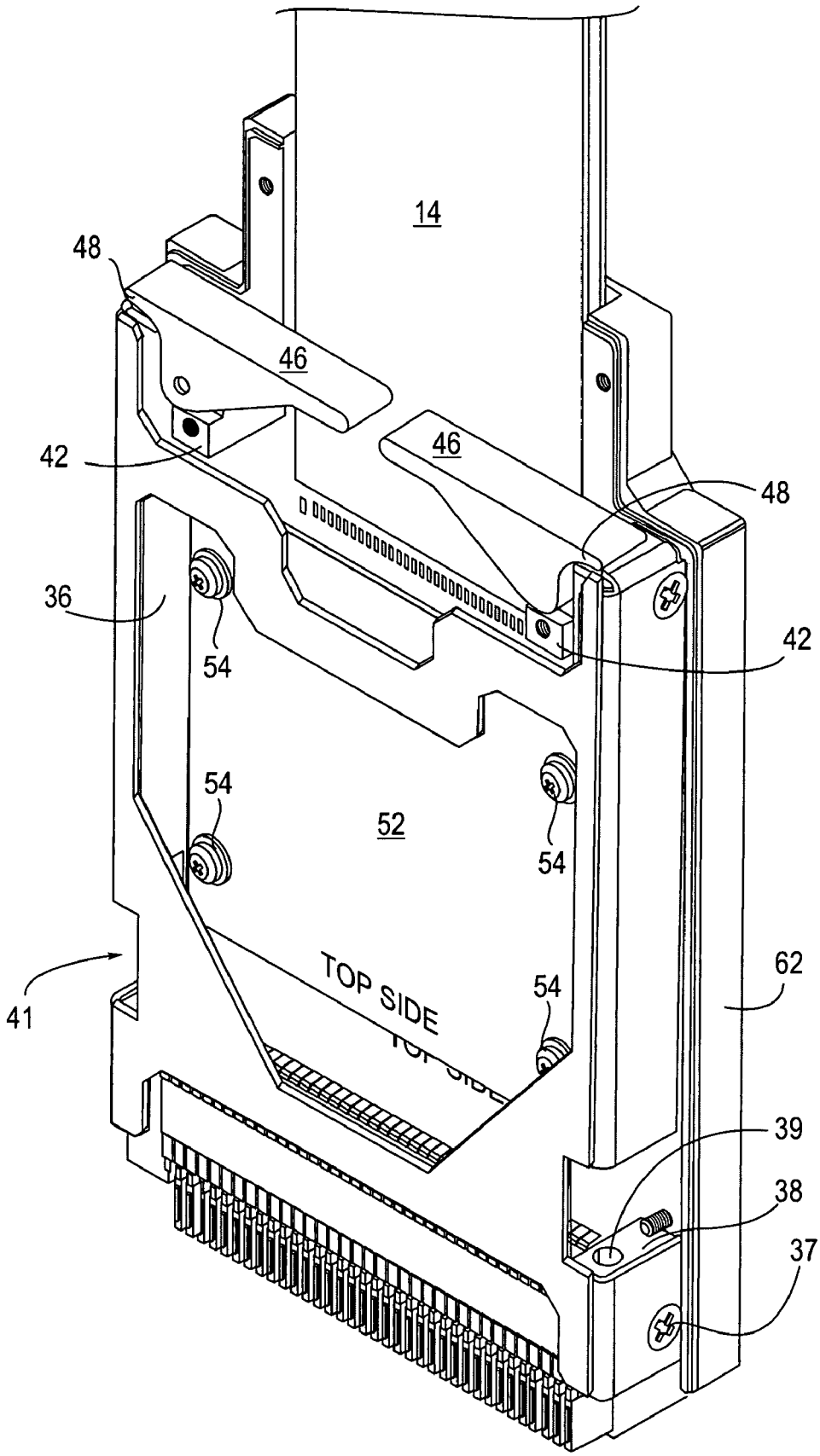
FIG. 5 illustrate the exemplary mating connector ejection system of FIG. 4 wherein the top housing unit is removed.

As shown in FIGS. 3 and 4, an exemplary mating connector ejection system 100 can preferably comprise a top housing unit 60 and a bottom housing unit 62. As can be seen in FIGS. 3 & 4, housing units 60 & 62 are preferably affixed to each other by screws 64 and encase frame 40, among others. As shown in FIG. 4, top housing unit 60 is configured such that ejection levers 46 are exposed from its top portion. When affixed together, top and bottom housing units 60 & 62, as shown in FIGS. 4 & 5, provide an opening (not shown) at one end such that contacts 32 and custom guidance blocks 38, among others, can extend beyond the length of top and bottom housing units 60 & 62 through the opening.

Figure 8:
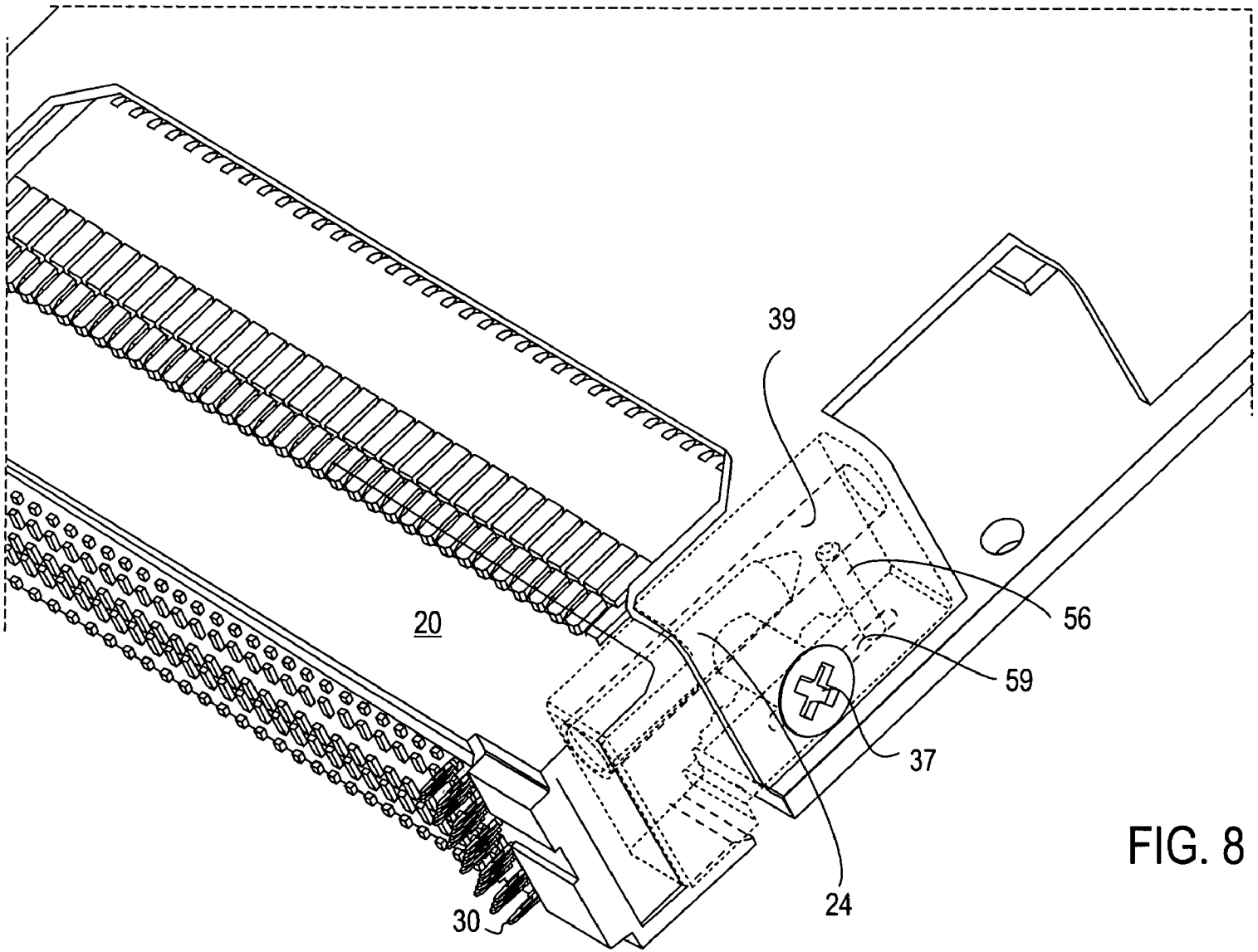
FIG. 8 is a detailed perspective drawing of the exemplary mating connector ejection system in an engaged state with a header connector of a target system.

The operation and the configuration of the mating connector ejection system 100 disclosed herein will now be described in more detail. When a user wants to interconnect one electronic system to another, they will insert the receptacle connector 22 into header connector 20. During this insertion, custom guidance blocks 38 will come into contact with guide pins 24 on header connector 20. Specifically, as shown in FIG. 8, guide pin 24 on header connector 20 is inserted into aperture 39 defined in custom guidance block 38. As contacts 32 in receptacle connector 22 are mated into the corresponding contacts within header connector 20, custom guidance blocks 38 and frame 40 are forced in the direction opposite the target system 16. This is possible partially because printed circuit board 50 affixed to receptacle connector 22 is slidably mounted (as described below) within frame 40. Frame 40 is configured to move with respect to the rest of pod system 12, and in particular with respect to the receptacle connector 22. The direction of travel of frame 40, along with guidance modules 36 and custom guidance blocks 38 affixed thereto, preferably are substantially in line with the axis of mating guide pins 24 on the header connector 20.

An ejection member 44 shown as having an L-shape in FIG. 2B is also preferably fastened to frame 40. As described above, it is possible to form a frame 40 such that it has an integrated ejection member 44. As shown in FIGS. 3 and 8 for example, guidance modules 36 and custom guidance blocks 38 can each have a pin 56 pressed into it. In one embodiment, as shown in FIG. 8, pin 56 can be partially embedded in custom guide block 38 and protrude perpendicularly out of guide block 38. Pins 56 preferably extend through a slotted aperture 59 formed in printed circuit board 50. The slotted apertures 59 in printed circuit board 50 can have any suitable orientation. For example, as shown in FIG. 8, the orientation of slotted apertures 59 is substantially parallel to the major axis of guide pins 24. Besides constraining the direction of travel, the length of slotted apertures 59 can partially determine the distance frame 40 will travel with respect to printed circuit board 50. The frame 40, guide modules 36, and custom guidance blocks 38 thereby can be inhibited from significant movement in any direction other than the intended direction. Each pin 56 can be configured to couple with a retaining ring 58 (see FIGS. 2A & 3). Retaining ring 58 can be provided in any suitable manner and can act as a stop to inhibit the pin from being removed from the relevant slotted aperture 59.

Figure 6A:
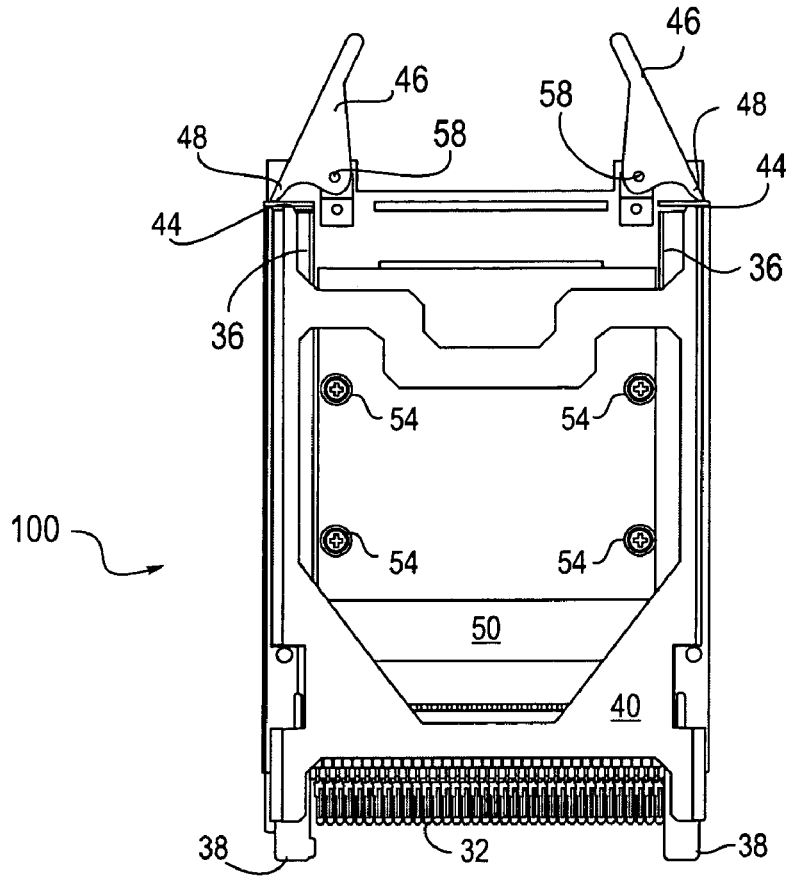
FIGS. 6A and 6B illustrates the mating connector ejection system of FIGS. 2A–2B in a disengaged state and in an engaged state.
Figure 6B:
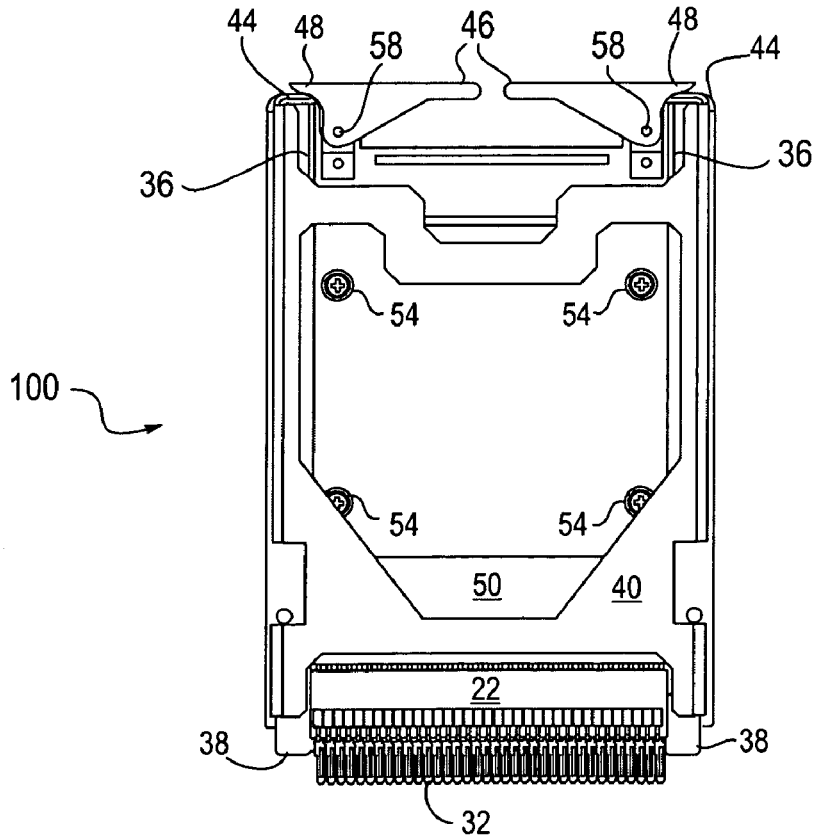
Figure 7:
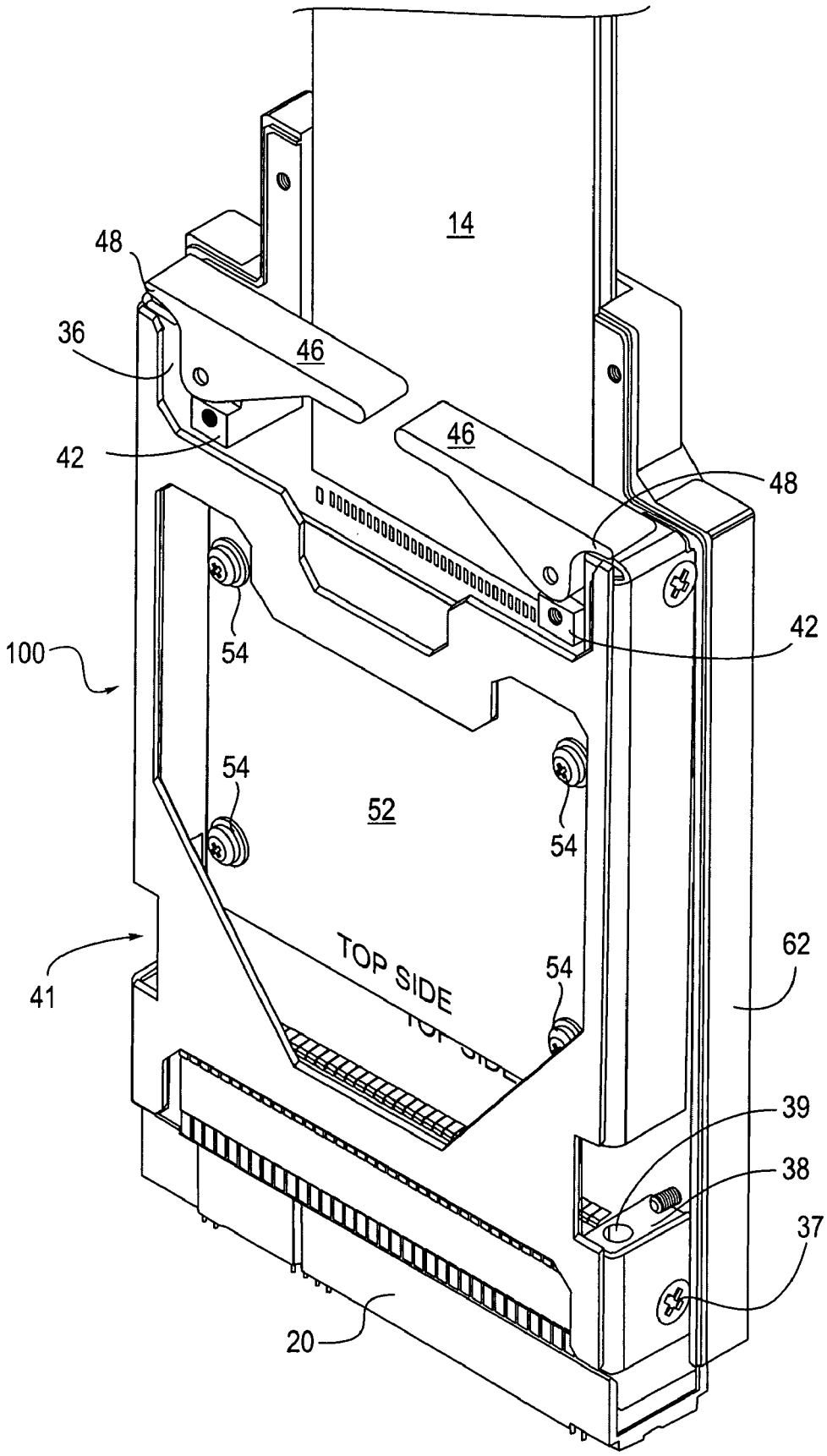
FIG. 7 is a perspective drawing of the exemplary mating connector ejection system engaged with a header connector of a target system.
Figure 9:
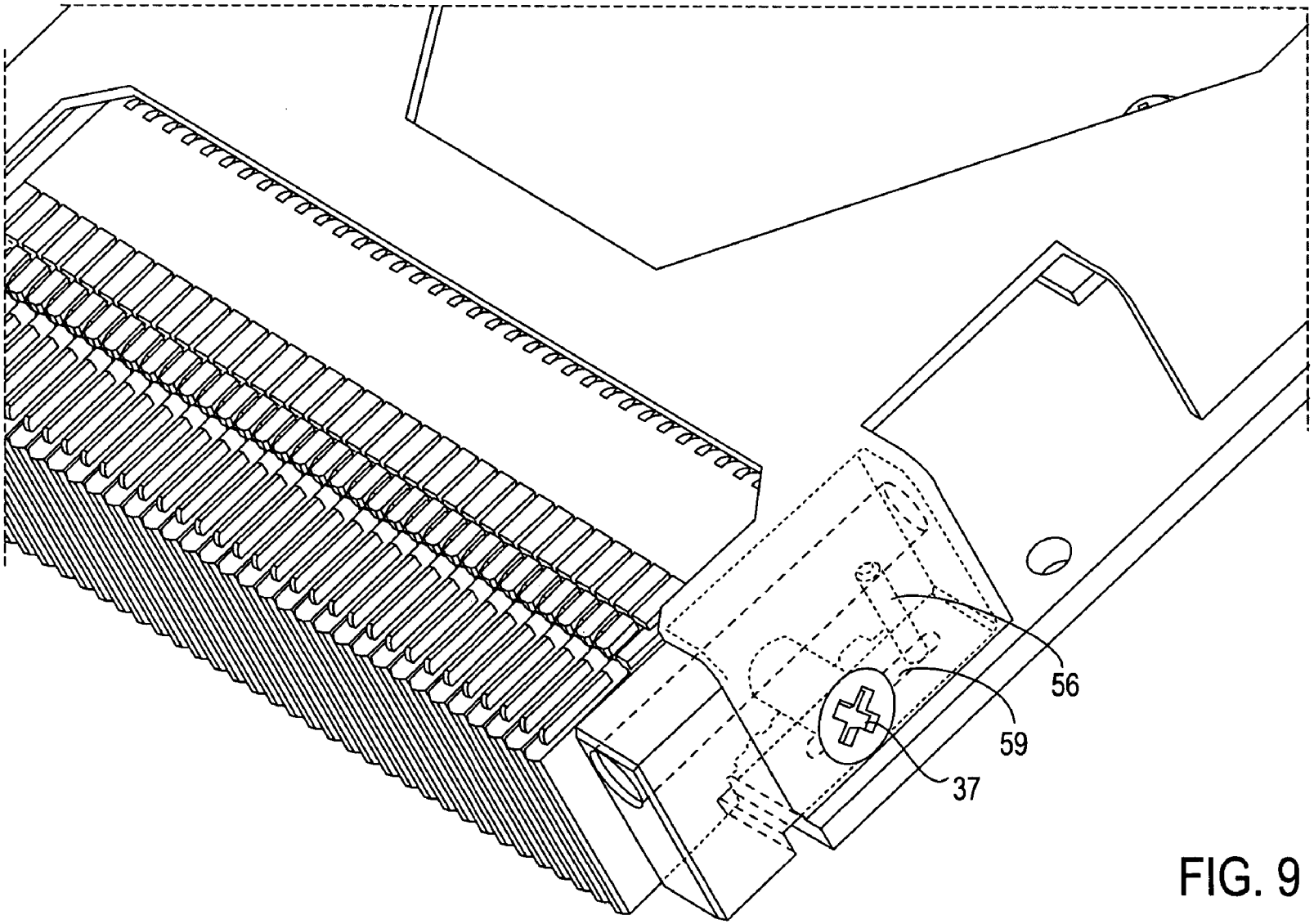
FIG. 9 is a detailed perspective drawing of the exemplary mating connector ejection system in an engaged state.
Figure 10:
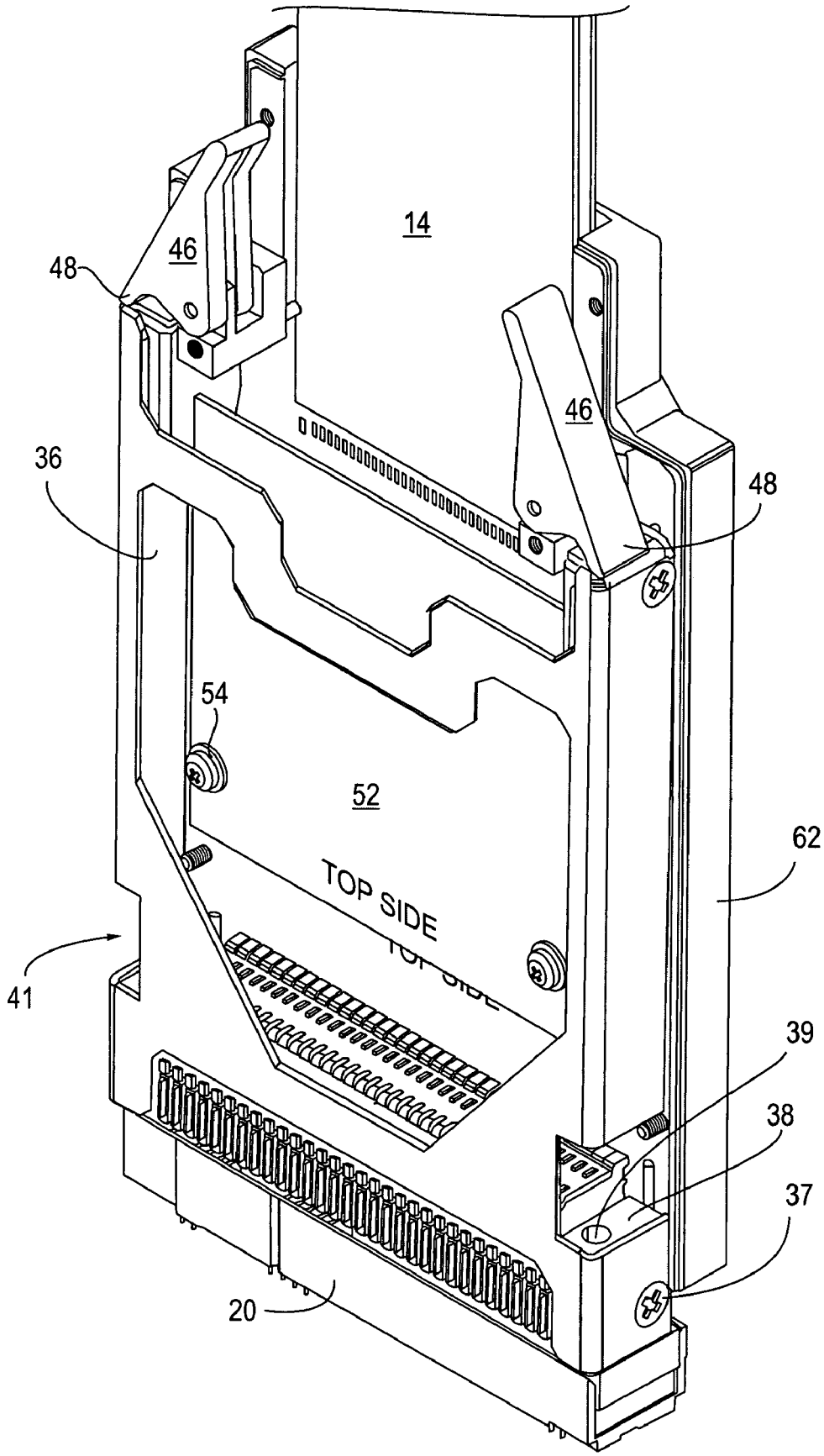
FIG. 10 is a perspective drawing of the exemplary mating connector ejection system disengaged from a header connector of a target system.

The mating connector ejection system 100 also comprises ejection levers 46, which are rotatably mounted in blocks 42 affixed to printed circuit board 50. As shown in FIG. 3, blocks 42 have pins 58 which hold ejection levers 46 in place on printed circuit board 50 as well as providing an axis around which ejection levers 46 can rotate about. Ejection levers 46 contain guide tabs 48 that mechanically contact ejection member 44. Prior to insertion, the mating connector ejection system 100 is oriented as shown in FIGS. 6A & 10. Prior to insertion, receptacle connector 22 is extended within frame 40 to a pre-insertion position (i.e., fully extended position), which can be seen in FIGS. 6A, 10, & 11. As the user begins inserting receptacle connector 22 into header connector 20, guide pin 24 on header connector 20 is inserted into aperture 39 provided in custom guidance block 38 (see FIG. 8), which becomes fully seated into header connector 20. This causes the printed circuit board 50 and receptacle connector 22 to mate within header connector 20. FIG. 7 shows the mating connector ejection system 100 in the mated connection. As described above, the distance and direction of this movement preferably is defined by the length and orientation of slot 59 provided in printed circuit board 50, as shown in FIGS. 8 & 9. That is, as the mating connector ejection system 100 transitions into an engaged state, pin 56 slides along slot 59 until pin 56 is stopped at the upper end of slot 56. Because one end of guidance module 36 is in mechanical contact with the portion of ejection member 44 perpendicular to the major axis of guidance module 36, insertion causes ejection member 44 to move guide tabs 48, which rotate ejection levers 46 such that the major axis of ejection levers 46 are perpendicular to the major axis of guidance modules 36, as can be seen in FIGS. 6B & 7.

As the quantity of connections of the connector system increases, it may become necessary to apply a larger extraction force to remove the receptacle connector 22 from the header connector 20. This is because, as mentioned above, the amount of insertion and extraction force needed for insertion and removal is substantially proportional to the number of pins in the connector. The mating connector ejection system 100 disclosed herein provides such an extraction force. As discussed, when the apparatus is inserted into header connector 20, ejection levers 46 are arranged such that they are perpendicular to the major axis of guidance modules 36. See FIGS. 6B and 7.

Figure 11:
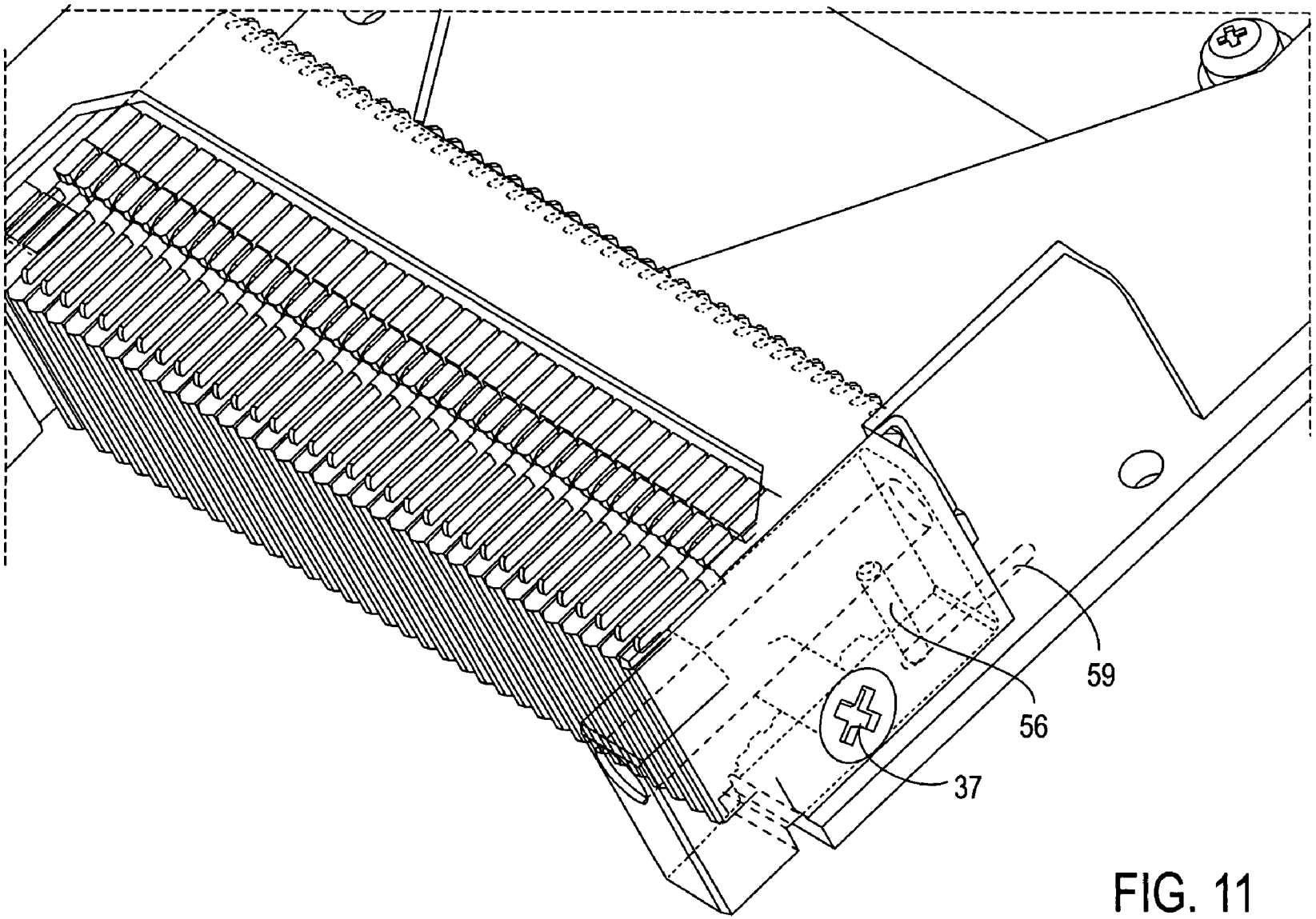
FIG. 11 is a detailed perspective drawing of the exemplary mating connector ejection system in a disengaged state.

Attention is now drawn to FIGS. 6A, 10 & 11, where an exemplary mating connector ejection system 100 is illustrated in a disengaged state. To remove the apparatus, the user will apply sufficient force to ejection levers 46 to cause ejection levers 46 to rotate about their mounting pin 58. This force will cause guide tabs 48 to move the tabbed portion of ejection member 44, which in turn will move frame 40, guidance modules 36, and custom guidance blocks 38 in the direction of guide pins 24. In other words, as shown in FIG. 11, force applied to ejection lever 46 will push custom guidance blocks 38 beyond the length of receptacle connector 22 and thus against header connector 20 mounted on printed circuit board 18 of target system 16. The distance and direction of travel of custom guidance blocks 38 (and frame 40 and guide module 36 affixed thereto) preferably are defined by the length and orientation of slot 59 provided in printed circuit board 50, as shown in FIG. 11. That is, as the mating connector ejection system 100 disengages, pin 56 slides along slot 59 until pin 56 is stopped at the lower end of slot 56. The force provided by the user for removing the apparatus increases because of the leverage provided by ejection levers 46. The force on guide pins 24 and printed circuit board 18 on target system 16 from custom guidance blocks 38 will act to pull contacts 32 in receptacle connector 22 out of the corresponding contacts in header connector 20. Preferably, frame 40 is configured and affixed to guidance modules 36 and custom guidance blocks 38 such that force applied to ejection levers 46 is evenly distributed to custom guidance blocks.

The mating connector ejection system 100 provides several improvements over prior solutions and alternatives. For example, the mating connector ejection system 100 can facilitate achievement of very high signal densities as well as facilitating disengagement of high signal density connectors. This is accomplished without increasing the size of the connector and/or additional mechanical components and/or complexity on the target side of the interface.

Advantageously, the connector ejection system can include one or more integrated ejection levers that can be configured to provide a quick, tool-less ejection mechanism. The sliding guide block design can integrate the ejection function and the guidance function into the same component. Force is applied to the rear portion of the mating connector, virtually eliminating any need for additional mechanical components on the mating side of the interface. The sliding rigid frame likewise can apply force evenly to both end regions of the mating connector.

As shown above, because the mating connector ejection system 100 requires no modification of the connector in the target system, (see e.g., header connector 20 as shown in FIGS. 1A–1B), it is advantageous to be utilized in an emulator environment. This "asymmetric" feature, however, can be applied to a wide range of environments other than emulators.

The various embodiments disclosed herein are susceptible to various modifications and alternative forms, and specific examples thereof have been shown by way of example in the drawings and are herein described in detail. It should be understood, however, that no limitations to the particular forms or methods should be inferred. To the contrary, the invention covers all modifications, equivalents, and alternatives falling within the spirit and scope of the claims.

What is claimed is:

1. An ejection system for a high extraction force electromechanical connector comprising:

a backplane coupled to a high extraction force electromechanical connector;

a frame slidably coupled with said backplane;

a guidance module having a first distal end affixed to said frame;

a custom guidance block affixed to said frame;

at least one ejection lever pivotally coupled with said backplane, said ejection lever having a guidance tab for providing mechanical contact with said first distal end of said guidance module, wherein, when a force is applied to said ejection lever, said force is transferred via said guidance tab to said first distal end of said guidance module and to said custom guidance block to facilitate disengagement of said high extraction force electromechanical connector from a corresponding connector.

2. The ejection system for a high extraction force electromechanical connector according to claim 1, wherein said backplane comprises a printed circuit board for transferring electrical signals between said high extraction force electromechanical connector and a cable.

3. The ejection system for a high extraction force electromechanical connector according to claim 1, further comprising an ejection member having a substantially L-shaped configuration such that a tabbed portion of said ejection member is coupled to said first distal end of said guidance module.

4. The ejection system for a high extraction force electromechanical connector according to claim 1, wherein said frame is configured to comprise an integrated L-shaped ejection member such that a tabbed portion of said ejection member is coupled to said first distal end of said guidance module.

5. The ejection system for a high extraction force electromechanical connector according to claim 1, further comprising a pin partially embedded in, and protruding out of, each of said guidance module and said custom guidance blocks and extending into a slotted aperture having a predetermined orientation and length provided in said backplane.

6. The ejection system for a high extraction force electromechanical connector according to claim 5, wherein said slotted aperture substantially determines direction and distance of travel of said frame, said guidance module, and said custom guidance block in relation to said backplane.

7. The ejection system for a high extraction force electromechanical connector according to claim 5, wherein said slotted aperture is oriented substantially parallel to a main axis of said guide pin module.

8. The ejection system for a high extraction force electromechanical connector according to claim 1 further comprising a top housing unit and a bottom housing unit for substantially encasing said frame.

9. The ejection system for a high extraction force electromechanical connector according to claim 1, wherein said custom guidance block comprises one or more mating guide apertures configured to mate with corresponding guide pin module provided in said corresponding connector.

10. A high extraction force electromechanical connector ejection system for facilitating disengagement of first and second cooperating connectors, comprising:

a backplane;

a frame slidably mounted on said backplane;

a custom guidance block configured to mate with a guide pin module coupled to a first cooperating connector, said custom guidance block affixed to said frame;

a guidance module affixed to said frame;

at least one ejection lever pivotally coupled to said backplane and having a guidance tab for providing mechanical contact with a first distal end of said guidance module; wherein, when a force is applied to said ejection lever, said force is transferred to said guidance tab and to said frame and to said custom guidance block forcing said first cooperating connector to disengage from said second cooperating connector.

11. The high extraction force electromechanical connector ejection system according to claim 10 further comprising a first and a second housing unit substantially encasing said frame.

12. The high extraction force electromechanical connector ejection system according to claim 10, wherein, when a force is applied to said application region, said frame evenly distributes said force to a terminal portion of said custom guidance block.

13. The high extraction force electromechanical connector ejection system according to claim 11, wherein said backplane comprises a printed circuit board coupled to a cable.

14. The high extraction force electromechanical connector ejection system according to claim 10, wherein said custom guidance block comprises one or more mating guide apertures configured to mate with said guide pin module coupled to said first cooperating connector.

15. The high extraction force electromechanical connector ejection system according to claim 10, wherein said ejection lever provides sufficient movement to said custom guidance block to break a mating contact between said first and second cooperating connectors.

16. The high extraction force electromechanical connector ejection system according to claim 10, wherein said guide pin module and said custom guidance block provide alignment guidance between said first and second cooperating connectors while said first and second cooperating connectors engage and/or disengage.

17. A high extraction force electromechanical connector ejection system comprising:

a pod comprising:

a backplane;

a frame slidably mounted on said backplane;

a guidance module coupled with said frame;

a custom guidance block coupled with said frame;

at least one ejection lever pivotally connected to said backplane and having a guidance tab;

a second cooperating connector configured to engage with a first cooperating connector connected to a guide pin module, said second cooperating connector connected to said backplane and move with respect to said frame in accordance with any force applied to an application region of said ejection lever, wherein, when a force is applied to said ejection lever, said force is transferred via said guidance tab to said guidance module, frame, and custom guidance block thereby forcing said first cooperating connector to disengage from said second cooperating connector.

18. The high extraction force electromechanical connector ejection system according to claim 17, wherein, when a force is applied to said ejection lever, said frame evenly distributes said force to a terminal portion of said custom guidance block.

19. The high extraction force electromechanical connector ejection system according to claim 17, wherein said custom guidance block comprises one or more mating guide apertures configured to mate with said guide pins.

20. The high extraction force electromechanical connector ejection system according to claim 17, wherein said ejection lever provides sufficient movement to said custom guidance block to break a mating contact between said first and second cooperating connectors.

21. The high extraction force electromechanical connector ejection system according to claim 17, wherein said custom guidance block provide alignment guidance between said first and second cooperating connectors while said first and second cooperating connectors engage and/or disengage.

22. The system for ejecting a high extraction force electromechanical connector according to claim 17, further comprising a pin partially embedded in, and protruding out of, each of said guidance module and said custom guidance blocks and extending into a slotted aperture having a predetermined orientation and length provided in said backplane.

* * * * *